United States Patent [19]

Hermes

[11] Patent Number: 4,961,228

[45] Date of Patent: Oct. 2, 1990

[54] METHOD OF AND DEVICE FOR ENCODING A SIGNAL, FOR EXAMPLE A SPEECH PARAMETER SUCH AS THE PITCH, AS A FUNCTION OF TIME

[75] Inventor: Dirk J. Hermes, Eindhoven, Netherlands

[73] Assignee: U.S. Philips Corporation, New York, N.Y.

[21] Appl. No.: 323,469

[22] Filed: Mar. 14, 1989

[30] Foreign Application Priority Data

Apr. 5, 1988 [NL] Netherlands ..... 8800854

[51] Int. Cl.[5] ..... G10L 7/02

[52] U.S. Cl. ..... 381/41

[58] Field of Search ..... 381/29-50; 364/513.5; 375/122

[56] References Cited

U.S. PATENT DOCUMENTS

| | | | |
|---|---|---|---|
| 2,959,639 | 3/1956 | Pierce | 381/31 |
| 3,023,277 | 2/1962 | Matthews | 381/31 |
| 3,278,685 | 10/1966 | Harper | 381/41 |
| 4,680,797 | 7/1987 | Benke | 381/36 |

OTHER PUBLICATIONS

IMAI et al., "An Efficient Encoding Method for Electocardiography using Spline Functions", "Systems and Computers in Japan," 5/85, No. 3, pp. 85-94.

*Primary Examiner*—Gary V. Harkcom
*Assistant Examiner*—John A. Merecki
*Attorney, Agent, or Firm*—Bernard Franzblau

[57] ABSTRACT

In a device for and a method of encoding a first signal ($f_0$), for example a speech parameter such as the pitch, as a function of time, to form a second signal (FIG. 2), a third signal (k) is derived from the first signal. The third signal is a measure of the curvature of the first signal as a function of time. The extrema (such as $k(t_1)$ in FIG. 1*b*) in this third signal are determined and the second signal is generated in the form of a sequence of information blocks ($B_1$, $B_2$, . . . ), of which one information block (such as $B_3$) contains time information corresponding to the instant ($t_3$) at which an extremum occurs in the third signal.

10 Claims, 2 Drawing Sheets

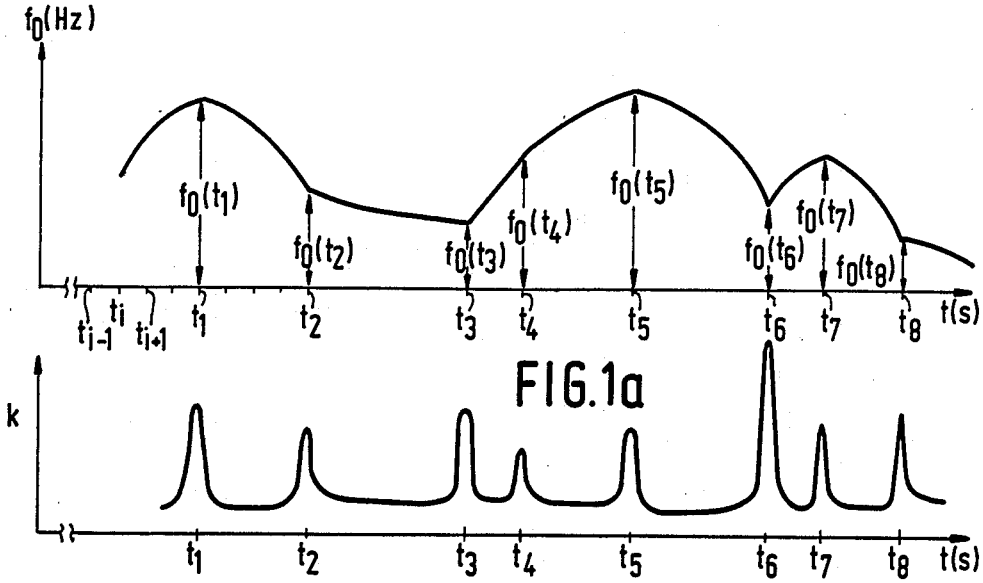
FIG.1a
FIG.1b
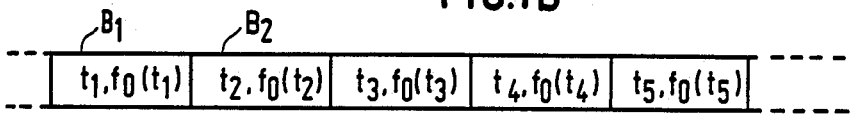
FIG.2
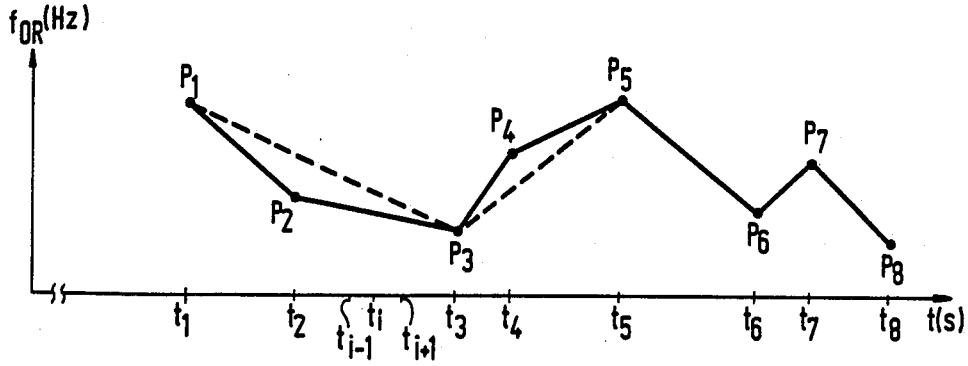
FIG.3

METHOD OF AND DEVICE FOR ENCODING A SIGNAL, FOR EXAMPLE A SPEECH PARAMETER SUCH AS THE PITCH, AS A FUNCTION OF TIME

BACKGROUND OF THE INVENTION

This invention relates to a method of encoding a first signal, for example, a speech parameter such as the pitch, as a function of time, to form a second signal, which second comprises a sequence of successive information blocks, an information block containing time information corresponding to a specific time instant, and containing amplitude information associated with said specific time instant, which amplitude information has been derived from the first signal. The invention also relates to a device for carrying out the method.

It is known to encode a signal, for example, a speech parameter such as the pitch in a speech signal, by determining the extrema in the signal, i.e. the relative and absolute minima and maxima in the signal. Subsequently, the signal is encoded into a sequence of information blocks, each information block indicating the instant at which an extremum occurs in the signal and the associated value of the extremum at this instant.

The encoded signal, which is constituted by the sequence of information blocks, can subsequently be transmitted via a transmission medium at a substantially lower bit rate than if the original signal were transmitted via the transmission medium. This is because the encoding provides a significant data reduction, enabling the signal to be transmitted via a transmission medium having a limited bandwidth. After reception of the encoded signal the original signal can be reconstructed by interpolation. The simplest interpolation is that in which the signal at instants situated between the instants of two successive information blocks is obtained by means of a straight line interconnecting two points defined by the information in two successive information blocks.

Another possibility is to reconstruct the original signal in that the information in the information blocks which relates to the magnitude of the first signal is approximated by a higher-order curve.

The reconstructed signal, for example, the pitch as a function of time, can subsequently be used to resynthesize a speech signal, for example by means of a speech chip. An example of such a chip is the N. V. Philips speech chip PCF 8200, as described in the Elcoma publication No. 217, entitled "Speech Synthesis: the complete approach with the PCF 8200".

The known method has the disadvantage that encoding is not always accurate enough and sometimes fails completely, for example, with respect to the pitch. From the publication "An efficient encoding method for electrocardiography using spline functions" by H. Imai et al., Systems and Computers in Japan, 1985, No. 3, May-June, pp. 85–94, a method is known which enables the signal to be encoded more accurately. In accordance with this method a third signal is derived from the first signal, which third signal is a measure of the curvature of the first signal as a function of time, extrema in said third signal are determined, and the first signal is encoded in the form of a sequence of information blocks, of which an information block contains time information corresponding to the instant at which an extremum occurs in the third signal. Determining the extrema in the curvature of the signal and encoding a signal on the basis thereof in this way yields a better approximation to the first signal.

An example of this is the encoding of a first signal which decreases continuously between a (relative) maximum and a (relative) minimum in conformity with two lines having different slopes and joining one another in a break-point situated between the instants at which the (relative) maximum and the (relative) minimum occur. The first-mentioned encoding method would yield two information blocks corresponding to the instants at which the (relative) maximum and the (relative) minimum occur and, for example, the associated values for the maximum and minimum. After decoding this would yield a reconstructed signal which varies between the maximum and the minimum in accordance with a straight line. The reconstructed signal no longer exhibits the break-point.

The second mentioned known encoding method allows for this break-point. The break-point yields a maximum or a minimum in the curve representing the curvature, so that also for this break-point an information block is generated. This information block indicates the instant at which the break-point occurs and, for example, the value of the original signal at this instant. When the information blocks are decoded this break-point again occurs in the reconstructed signal.

SUMMARY OF THE INVENTION

Nevertheless, situations arise in which the improved method of Imai et al. also fails or is still too inaccurate. Therefore, it is an object of the invention to provide a method, and a device for carrying out the method, which encodes the signal even more accurately and which hardly ever fails.

To this end the method in accordance with the invention is characterized in that for deriving the third signal, for each of a number of instants at which a sample of the first signal is available, two straight lines are determined which intersect one another at said instant, in that the lines are determined as approximations to lines through a plurality of samples of the first signal for instants in a time interval within which said instant is situated, and in that for every instant the magnitude of the angle between the two intersecting lines at said instant is taken as the third signal. The invention is based on the recognition of the fact that owing to noise in the first signal the method of encoding the signal as proposed by Imai et al. does not function correctly. In accordance with the invention, every time two lines are determined the influence of noise is reduced substantially, so that a better coding is achieved. It is therefore a further object to derive a special encoding method which is substantially immune to noise in the first signal.

In addition to the time information the common value of the two lines at the intersection may be included in every information block. Reconstruction is now possible on the basis of said common value(s). Reconstruction is then achieved by interpolation between the points of intersection. This method may be characterized further in that the two lines to be determined for every instant are derived from the samples situated within the time interval by means of a least-squares method.

The device for carrying out the method as defined above, comprises an input terminal for receiving the first signal, for example, a speech parameter such as the pitch, as a function of time. An encoding unit has an input coupled to the input terminal, and has an output.

The encoding unit is constructed to encode the first signal to form a second signal comprising a sequence of successive information blocks, an information block containing time information corresponding to a specific time instant, and containing amplitude information associated with said instant, which amplitude information has been derived from the first signal. The encoding unit is constructed to supply the second signal at its output, which output is coupled to the output terminal of the device to supply the second signal. The the encoding unit is adapted to derive from the first signal a third signal which is a measure of the curvature of the first signal as a function of time, to determine extrema in said third signal, and to generate a sequence of information blocks, of which an information block contains time information corresponding to an instant at which an extremum occurs in the third signal.

For deriving the third signal, the encoding unit is adapted to determine, for each of a number of instants at which a sample of the first signal is available, two lines intersecting one another at said instant and extending through a plurality of samples of the first signal at instants within a time interval within which said instant is situated, and to determine the angle between said two lines. In the latter case the device may be characterized further in that the encoding unit utilizes a least-squares method to derive the lines from those samples of the first signal which are situated within said time interval.

The amplitude information in an information block may correspond to the magnitude of the first signal at said time instant.

However, there are other ways of determining the amplitude information of an information block. Another possibility is, for example, that the amplitude information in an information block corresponds to the value at the intersection of the two lines which intersect one another at said instant.

BRIEF DESCRIPTION OF THE DRAWINGS

Embodiments of the invention will now be described in more detail, by way of example, with reference to the accompanying drawings. In the drawings:

FIG. 1*a*, shows a first signal, for example the pitch $f_0$, as a function of time and, FIG. 1*b*, shows the curvature in the signal of FIG. 1*a* as a function of time, FIG. 2 shows the encoded signal comprising the sequence of information blocks, FIG. 3 shows the reconstructed signal after decoding.

DESCRIPTION OF THE PREFERRED EMBODIMENTS

FIG. 1*a* diagrammatically shows a first signal, in the present example the pitch $f_0$ in a speech signal, as a function of time. The signal is represented as a continuous curve. In general the signal is available in the form of samples at equidistant discrete instants . . . $t_{i-1}$, $t_i$, $t_{i+1}$ . . . etc. (for example, 20 ms each). FIG. 1*b* shows diagrammatically the third signal representing the curvature k of the first signal $f_0$ of FIG. 1*a* as a function of time. If the signal $f_0$ takes the form of samples at equidistant instants, the curvature will also be determined for said equidistant instants . . . $t_{i-1}$, $t_i$, $t_{i+1}$ . . . etc. FIG. 1*b* does not show the actual curvature but a kind of absolute value of the curvature. This means that in the curve of FIG. 1*b* only the (relative) maxima have to be considered. If the actual curvature had been plotted, in which case for example a convex curvature would yield a positive value and a concave curvature a negative value, both the (relative) maxima and the (relative) minima in the curve would have to be considered in order to determine the extrema. From FIG. 1*b* it is apparent that in the curve k extrema appear for the instants $t_1$, $t_2$, . . . , $t_8$. These extrema correpsond to points of maximum curvature in the curve $f_0$ of FIG. 1*a*. The signal $f_0$ in FIG. 1*a* is now encoded by generating a sequence of information blocks, see FIG. 2, in which an information block (such as the block $B_1$ in FIG. 2) indicates the instant ($t_1$) at which an extremum occurs in the curve k and the amplitude value of the pitch at this instant ($f_0(t_1)$).

In order to obtain a reconstructed signal $f_{0R}$ for the pitch, the sequence of information blocks is decoded as is indicated by means of the solid line in FIG. 3.

By drawing straight lines between the successive points $P_1$ to $P_8$, which correspond to the information in the eight information blocks $B_1$ to $B_8$ in FIG. 2, the pitch for the instants . . . $t_{i-1}$, $t_i$, $t_{i+1}$ . . . etc. situated between the instants $t_1$ to $t_8$ is obtained, in fact, by interpolation.

The dashed lines between the instants $t_1$ and $t_3$ and between $t_3$ and $t_5$ respectively indicate how the reconstructed signal would have been if only the extrema in the signal had been used for encoding the signal. It is obvious that the solid line in FIG. 3 is in closer conformity with the original curve of FIG. 1*a* than is the dashed line in FIG. 3.

Figure 4:
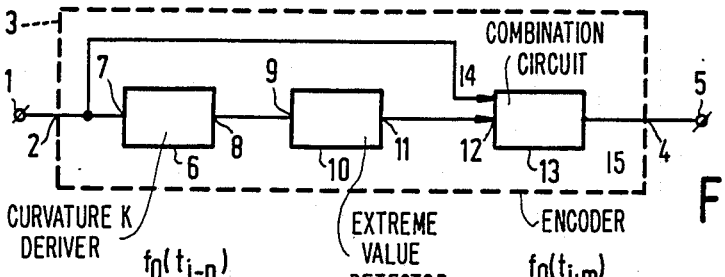
FIG. 4 shows a device for encoding the signal, FIG. 5*a* diagrammatically illustrates how the instantaneous curvature is determined

FIG. 4 shows diagrammatically a device for encoding the signal. The device comprises an input terminal 1 for receiving the first signal. The input terminal 1 is coupled to an input 2 of an encoding device 3. The encoding device 3 processes the signal as described with reference to FIGS. 1 and 2 and produces the sequence of information blocks on its output 4, which is coupled to the output terminal 5, where this sequence of information blocks is available, for example, for the purpose of transmission via a transmission medium.

The encoding device 3 comprises a first unit 6, having an input 7 constituting the input 2 of the encoding device 3. The first unit 6 is constructed to determine for every instant the curvature k of the signal $f_0$ and to produce the curve k representing this curvature at an output 8. This output 8 is coupled to an input 9 of an extreme-value detector 10. This extreme value detector 10 determines the extreme values in the curve k and supplies information about the instants ($t_1$ to $t_8$) at which said extreme values occur to an output 11. This output 11 is coupled to a first input 12 of a combination circuit 13. The extreme-value detector 10 in general detects absolute and relative extreme values, i.e. maxima and minima, namely when the curvature is plotted for positive values (for example if it is a convex curvature) and for negative values (if it is a concave curvature). If only an absolute value is plotted for the curvature the extreme-value detector 10 will determine only absolute and relative maxima. The input 2 of the encoding device 3 is coupled to a second input 14 of the combination circuit 13. For every instant that a signal is applied via the input 12 the combination circuit 13 determines the value of the signal $f_0$ associated with this instant and applied to it via the input 14, and generates the sequence of information blocks ($B_1$ to $B_8$) as shown in FIG. 2 on an output 15. The output 15 is coupled to the output terminal 4 of the encoding device 3.

The curvature k can be determined in various ways. A known method is to start from the second time derivative of the signal $f_0$.

The curvature k can be computed, for example, by means of the following formula:

$$k = f0''/\{1+(f0')^{3/2}\}$$

where $f_0'$ and $f_0''$ are the first time derivative and the second time derivative of the signal $f_0$.

Computing the second derivative in fact means subjecting the signal $f_0$ to a strong high-pass filtration. This results in brief and rapid pitch variations being amplified because these have a high-frequency content. These variations belong to the domain of what is called micro-intonation, i.e. they are perceptually non-significant. Micro-intonation may be regarded as a form of noise in the signal, which disturbs the computation of the derivatives. For this reason the computation of the derivatives should be preceded by a substantial smoothing (of the pitch contour), which only leaves the more gradual perceptually relevant pitch variations intact. However, this does not yet provide a satisfactory encoding accuracy.

Another consequence of thus determining the curvature is that if a time interval of a comparatively steady pitch is followed by a time interval in which the pitch varies rapidly, the curve representing the curvature will exhibit a maximum which is shifted to some extent towards the stable interval.

Figure 5A:
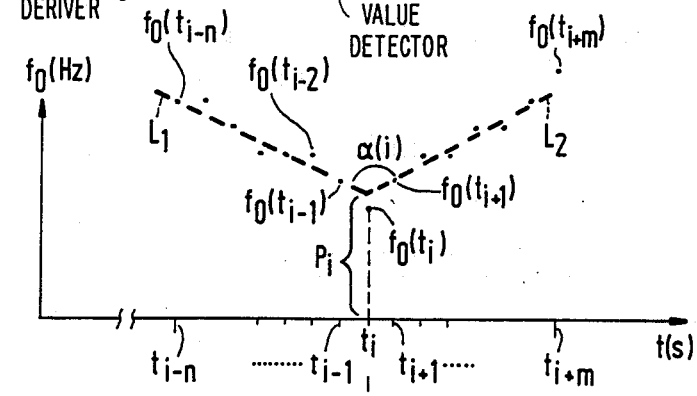
FIG. 5*b*, shows the weighting function used for this purpose.
Figure 5B:
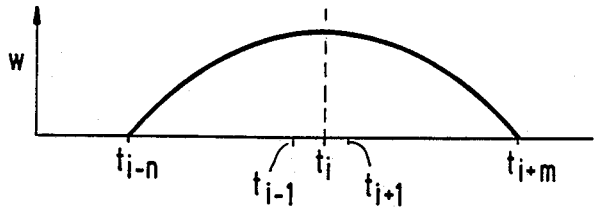

In order to preclude this the curvature k, in accordance with the invention, is now determined in a manner to be explained with reference to FIGS. 5*a* and 5*b*.

First of all, in order to determine the curvature $k_i = k(t_i)$ at a specific instant $t_i$, two straight lines $L_1$ and $L_2$ are determined for this instant. In FIG. 5*a* these two lines are represented as broken lines $L_1$ and $L_2$. The two lines should intersect at the instant $t_i$. The lines $L_1$ and $L_2$ are determined as approximations to lines through the points $f_0(t_{i-n})$ to $f_0(t_{i+m})$. Both lines can be determined by means of a least-squares method. This enables the influence of time samples for instants further away from $t_i$ to be reduced by means of a weighting function as illustrated in FIG. 5*b*. If desired, the amplitude for the pitch may be included in the weighting function. The values n and m may be equal to one another.

Approximation by means of the least-squares method implies that the quantity M, which can be expressed by means of the formula:

$$M = \Sigma\ w(t_j)\,[L_j(t_j) - f_0(t_j)]^2 + j<i\ \Sigma\ w(t_j)\,[L_j(t_j) - f(t_j)]^2 + j>i\ W(t_i)\,[p_i - f_0(t_i]^2$$

should be minimal. In the formula $p_i$ is the common value of the two lines at the intersection of the two lines at the instant $t_i$.

This enables the two lines to be determined. The angle $\alpha(i)$ between the two lines $L_1$ and $L_2$ is now a measure of the curvature of the pitch $f_0$ at the instant $t_i$.

For every instant $t_i$ the above process is carried out, so that for all instants $t_i$ the value $\alpha(i)$ is obtained. Determining the instants for which the curvature is maximal now means that the minima and the maxima in the function $\alpha(i)$ must be determined.

Figure 6:
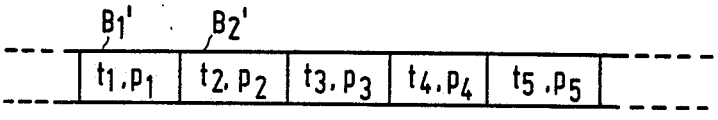
FIG. 6 shows the encoded signal with different amplitude information in the information blocks.
Figure 7:
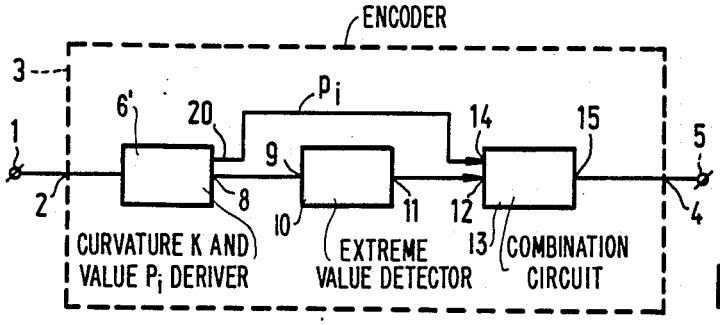
FIG. 7 shows the device for supplying the encoded signal in FIG. 6.

It is possible to use the common values $p_i$ at the instants $t_1$ to $t_8$ for the amplitude information in an information block. This is represented by the second signal in FIG. 6. The device shown in FIG. 4 should then be slightly transformed, see FIG. 7. The first unit 6' is now slightly modified and now has a second output to which the values $p_i$ are applied, which are subsequently transferred to the input 14 of the combination circuit 13. This combination circuit 13 selects exactly those values $p_1$ associated with the instants $t_1$ to $t_8$. The signal shown in FIG. 6 will then appear on the output 15.

It is to be noted that the invention is not limited to the embodiments described herein. The invention also applies to embodiments which differ from the embodiments shown as to details which are not relevant to the invention. For example, the method and the device may be used for encoding signals other than those representing the pitch. An example of this is the encoding of the curves for the formant frequencies as a function of time.

I claim:

1. A method of encoding a first signal as a function of time, to form a second signal which comprises a sequence of successive information blocks, wherein the first signal includes a plurality of samples thereof and an information block contains time information corresponding to a specific time instant and contains amplitude information related to the first signal and corresponding to said specific time instant, said method comprising; deriving a third signal from the first signal, said third signal being a measure of the curvature of the first signal as a function of time, extrema in said third signal being determined whereby said second signal is derived in the form of said sequence of information blocks in which an information block contains time information corresponding to an instant at which an extremum occurs in the third signal, characterized in that for deriving the third signal, for each of a number of instants at which a sample of the first signal is available, the method further comprises determining two straight lines which intersect one another at each said instant, wherein the lines are determined as approximations to lines through a plurality of samples of the first signal for instants in a time interval within which said instant is situated, and taking, for every instant, the magnitude of the angle between the two intersecting lines at said instant as the third signal.

2. A method as claimed in claim 1, wherein the two lines to be determined for each instant are derived from the samples situated within the time interval by means of a least-squares method.

3. A device for encoding a first signal which varies as a function of time comprising: an input terminal for receiving the first signal which comprises a plurality of signal samples, an encoding unit having an input coupled to the input terminal and having an output, said encoding unit being constructed to encode the first signal to form a second signal comprising a sequence of successive information blocks, an information block containing time information corresponding to a specific time instant and containing amplitude information related to the first signal and which corresponds to said specific time instant, the second signal appearing at said output, wherein the encoding unit comprises means for deriving from the first signal a third signal which is a measure of the curvature of the first signal as a function of time and for determining extrema in said third signal thereby to generate said second signal wherein an information block contains time information corresponding to an instant at which an extremum occurs in the third signal, characterized in that said means for deriving the third signal determines, for each of a number of instants at which a sample of the first signal is available, two lines intersecting one another at said instant and extending through a plurality of samples of the first signal at instants within a time interval within which said instant is situated, and determines the angle between said two intersecting lines.

4. A device as claimed in claim 3, wherein the encoding unit intersecting lines from samples of the first signal which are situated within said time interval and by means of a least-squares method.

5. A device as claimed in claim 4, wherein the amplitude information in an information block corresponds to the magnitude of the first signal at said specific time instant.

6. A device as claimed in claim 4, wherein the amplitude information in an information block corresponds to the intersection of the two lines which intersect one another at said instant.

7. A device as claimed in claim 3, wherein the amplitude information in an information block corresponds to the magnitude of the first signal at said specific time instant.

8. A device as claimed in claim 3, wherein the amplitude information in an information block corresponds to an amplitude value at the intersection of the two lines which intersect one another at said specific time instant.

9. A method of encoding a first analog type signal to form a second signal which comprises a sequence of successive information blocks, wherein the first signal includes a plurality of samples thereof and each information block contains time information corresponding to a specific time instant and contains amplitude information related to the first signal and corresponding to said specific time instant, said method comprising; deriving from the first signal a third signal indicative of the curvature of the first signal as a function of time by determining, for each of a number of time instants at which said first signal is sampled, two straight lines which intersect one another at each said instant, the lines being determined as approximations to lines through a plurality of samples of the first signal for instants in a time interval within which said specific time instant occurs, and deriving, for every specific time instant, the magnitude of the angle between the two intersecting lines at said specific time instant to form the third signal, and determining extrema in said third signal from which said second signal is derived and in which an information block contains time information corresponding to an instant at which an extremum occurs in the third signal.

10. A device for encoding a first signal which varies as a function of time into a second signal which comprises a sequence of successive information blocks with each information block containing time information corresponding to a specific time instant and containing amplitude information related to the first signal at a said specific time instant, said device comprising; an input terminal for receiving a plurality of signal samples of said first signal, means coupled to said input terminal for deriving from the first signal a third signal which is a measure of the curvature of the first signal as a function of time by determining, for each of a number of instants at which said signal samples of the first signal occur, two lines intersecting one another at each said instant and extending through a plurality of samples of the first signals at instants within a time interval within which said specific time instant occurs, and determining the angle between said two intersecting lines, means coupled to said deriving means for generating a signal indicative of time instants at which extrema occur in said third signal, and a combination unit circuit responsive to the time signal and to an amplitude signal determined by said first signal in order to produce at an output thereof said second signal wherein each information block contains time information corresponding to an instant at which an extremum occurs in the third signal.

* * * * *